US006254987B1

(12) United States Patent
Delker

(10) Patent No.: US 6,254,987 B1
(45) Date of Patent: Jul. 3, 2001

(54) MONOFIL BICOMPONENT FIBRES OF THE SHEATH/CORE TYPE

(75) Inventor: Rex Delker, Wehringen (DE)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/362,881

(22) Filed: Jul. 29, 1999

(30) Foreign Application Priority Data

Jul. 29, 1998 (DE) ..... 198 34 008

(51) Int. Cl.[7] ..... D01F 8/00; D01F 8/14
(52) U.S. Cl. ..... 428/373; 428/370
(58) Field of Search ..... 428/372, 370, 428/373, 374; 524/420

(56) References Cited

U.S. PATENT DOCUMENTS 5,753,736 * 5/1998 Bhat et al. ..... 428/372
6,051,175 * 4/2000 Kurihara et al. ..... 524/420

FOREIGN PATENT DOCUMENTS

| | | |
|---|---|---|
| 0506983 | 4/1992 | (EP) . |
| 0763611A1 | 3/1997 | (EP) . |
| 4272225 | 9/1992 | (JP) . |
| 4272226 | 9/1992 | (JP) . |
| 95175617/23 | 9/1993 | (JP) . |
| 95355661/46 | 3/1994 | (JP) . |
| 08051798 | 9/1997 | (JP) . |
| WO83/01253 | 4/1983 | (WO) . |
| WO95/16064 | 6/1995 | (WO) . |
| WO98/28472 | 7/1998 | (WO) . |

* cited by examiner

*Primary Examiner*—N. Edwards
(74) *Attorney, Agent, or Firm*—Burns, Doane, Swecker & Mathis, L.L.P.

(57) ABSTRACT

The invention is directed to a sheath core monofilament which displays enhance abrasion resistance. The core is a liquid crystalline polyester and the sheath is a blend of 1–5 percent by weight polycarbonate and a polyester.

10 Claims, No Drawings

MONOFIL BICOMPONENT FIBRES OF THE SHEATH/CORE TYPE

DESCRIPTION

The invention relates to monofils in the form of bicomponent (conjugate) fibres of the sheath/core type which surround a core containing a liquid-crystalline polymer; it also relates to their manufacture and use, especially in the production of paper machine clothing and paper machine fabrics.

A monofil as defined in this invention means a continuous yarn consisting of a single continuous fibre made with or without twist and having a diameter of at least 0.01 mm, preferably 0.08 mm, and in particular 0.1. mm and more. It differs, especially by its considerably larger diameter, from monofilaments in the form of sheath/core fibres which are commonly made for textile purposes.

Monofils are used primarily in the manufacture of technical articles and in particular surface structures with technical applications, contrary to multifilament yarns which are constructed of fine individual filaments for use mainly in the textile industry.

Monofils in the form of bicomponent fibres of the sheath/core type are known in prior art and have been described, for example, in EP 0 763 611 A1. There, the core component is a polyester, while the sheath is a polyamide. The polyester of the core can also be a liquid crystalline polymer. To improve adhesion between the core and the sheath components, the sheath contains an adhesion-promoting polymer.

In spite of an adhesion-promoting means, adhesion still leaves something to be desired, which means that especially under strong mechanical loads, the core is at least partly separated from the sheath component, which has a negative effect on the mechanical properties of the product made from such monofils. Their strength characteristics could be improved as well.

Japanese patent application JP-07/097,719-A teaches the manufacture of multi-component fibres of the sheath/core type, whose core consists of an aromatic polyester and whose sheath contains a semi-aromatic polyamide. The abstract of this Japanese application does not include notes for manufacturing monofils, and in that case, too, adhesion between core and sheath leaves something to be desired.

Finally, Japanese patent application JP-07/243,128 describes a sheath/core type filament that contains a liquid-crystalline polyester core and a sheath of thermoplastic polymer. This thermoplastic polymer of the sheath forms a so-called sea component and contains an anisotropic aromatic polyester as so-called island components. This means that the sheath is made of a matrix of a thermoplastic polymer in which large inclusions are embedded which are not compatible with the matrix.

Although a number of monofils of the sheath/core type are already known whose core contains a liquid-crystalline polymer, there is still a demand for improved monofils of this type.

It is therefore the object of the present invention to make available monofils. in the form of bicomponent fibres of the sheath/core type which comprise a core containing a liquid-crystalline polymer and a sheath enclosing this core in which cohesion between core and sheath components is very good, which are not prone to fibrillation, have a very high degree of abrasion resistance and good strength characteristics, and whose sheath provides excellent protection for the core.

A monofilament which displays enhanced abrasion resistance is provided having a diameter of at least 0.01 mm and the sheath is formed by the melt extrusion of a substantially homogeneous blend of 1 to 5 percent by weight polycarbonate and a polyester selected from the group consisting of polyethylene terephthalate, polypropylene terephthalate, polybutylene terephthalate, polyethylene-2,6-naphthalate, poly(1,$^4$-bis(hydroxymethyl)-cyclohexaneterephthalate, and mixtures of the foregoing.

The monofils according to the invention can be manufactured, for example, in the following manner:

Core and sheath components are molten separately in extruders and spun in a bicomponent spin pack using a one-step process. After leaving the spinneret, the issuing monofils below the spinneret are cooled in a shaft, for example with a tempered gas stream. It is also possible to cool the fibres by means of a liquid. In that case, the strands are cooled down to a temperature which is preferably at least 0 to 30° C. below that of vitrification of the sheath material. The spray speed and the doffing (the so-called spin speed) are adjusted to each other until a draft of at least 1:5 to 1:30, preferably 1:8 to 1:15, is achieved.

Since the spin draft and also the quenching process can already be used to determine the final characteristics of the monofils, neither subsequent stretching nor thermal fixing are necessary to allow for shrinkage. Subsequent stretching is not necessary either. By adjusting the drawing conditions, it is possible to provide the monofils with a partial orientation, which means that purely amorphous as well as partly crystalline states can be achieved.

In general, the monofils are wound in a roll after they are drawn off.

It is possible to temper the monofils in an additional step. It has been proven advantageous when tempering is performed within a certain temperature range. Thus, it is possible to begin tempering at 200° C. and then to increase the temperature continuously to 270° C., for example. Of course, the tempering conditions depend especially on the sheath material used. The maximum temperature should lie 20 to 30° C. below the melting temperature of the sheath polymer.

The core can make up 40 to 90 percent of the cross-sectional area and the sheath can make up 10 to 60 percent of the cross-sectional area. The core can be arranged centrally or asymmetrically. The monofilament cross-section can be oval, rectangular or n-sided where $n \geqq 3$.

A customary liquid-crystalline polymer can be used as the core component. A single polymer can be used, but it is also possible to use a mixture of several liquid-crystalline polymers. Such a mixture should be spun in a form that is as homogeneous as possible. Instead of using mixtures of pure liquid-crystalline polymers, it is also possible to use mixtures of one or more liquid-crystalline and one or more non-liquid-crystalline polymers.

Preferred as liquid-crystalline polymers are polycondensation products on the basis of p-hydroxybenzoic acid and 2,6-hydroxynaphthoic acid, especially those synthesized of 70 to 80, preferably 72 to 74 mol % of p-hydroxybenzoic acid and 20–30, preferably 26 to 29 mol % 2,6-hydroxynaphthoic acid.

Sheath components to be used can be customary polyesters such as polyethylene-terephthalate, polypropyleneterephthalate, polybutyleneterephthalate, but also polyethylene-2,6-naphthalate or poly-(1,4-bis (hydroxymethyl)-cyclohexaneterephthalate.

These polyesters can be used alone or as mixtures.

Another polymer suitable for the sheath are polycarbonates. These are commercially available; the product sold under the trade name of Makrolon has been very successful. In terms of the invention, polycarbonates are especially suitable as sheath components when mixed with other polyesters.

In a particularly advantageous embodiment of the invention, the sheath contains one or more elastomeric polyesters. These are in particular copolyesters on the basis of dicarboxylic acid such as terephthalic acid or its derivatives and a diol such as 1,4-butane diol or ethylene glycol and a polyglycol, especially for example polyglycol on the basis of tetrahydrofuran.

Preferred is polytetrahydrofuran butylenterephthalate. This elastomeric polyester can be synthesized, for example, by polycondensation of dimethylterephthalate, butane diol and polytetrahydrofuran of the formula $HI(CH_2CH_2CH_2CH_2O)_nH$.

In this formula, n is a mean and can assume various values, with corresponding molecular weights which are advantageous in the range of about 600 to 2000, and especially at a magnitude of 1000. A mean molecular weight of about 1000 corresponds to a mean of 17 for n.

The sheath of the monofil bicomponent fibre should be substantially homogeneous, i.e. have no macroscopically discernible heterogeneous structure as, for example, a matrix with discrete embedded islands. In the case if mixtures, single-phased mixtures are preferred. In the case of components which normally occur in two-phased form at the extruding temperature, intensive mixing such as stirring is necessary, to ensure proper homogenization.

Suitable tempering conditions can be selected by means of simple pre-tests, to ensure optimal characteristics. It is practical to perform tempering over a certain period of time, preferably for several hours.

The physical properties of the monofil according to the invention, such as strength, modulus, shrinking, contraction and creep resistance under stress and the effect of temperature, are determined to a large degree by the physical properties of the core. Main task of the sheath is to protect the core against fibrillation, abrasion and soiling. The sheath also makes processing easier and improves serviceability.

The monofilaments according to the invention can be used advantageously for a large number of applications, including those desirable in the manufacture of fabrics for paper machines such as paper machine clothing in the forming, press and dryer sections of paper machines. They can be used to make filter fabrics, coated or uncoated conveyor belt fabrics, etc. For example, the monofilaments may be used solely as shute material, but it is also possible to make fabrics completely of the monofilaments according to the invention. Another application for fabrics made from these fibres is the manufacture of reinforcement liners in automobile tires. Such fabrics can also be used in silk screening.

It was particularly surprising that the monofils according to the invention are considerably better protected against fibrillation, that they can be rewound without problem and can be used either as warps or shutes in the manufacture of fabrics. The monofils are characterized by a particularly low tendency to creep.

By adding carbodiimide, especially in the sheath component, hydrolysis resistance, which is good to start with, can still be considerably improved. Thus, after 85 hours of saturated vapour treatment at 135° C., residual stability increases from 85% to over 90%.

The invention is described in detail by means of the following examples:

EXAMPLE 1

A fully aromatic polyester, namely the product Vectra A 910 (LCP), was chosen for the core, and a blend consisting of 96.4% Polyclear N 100 (PEN)—a polyethylenenaphthalate—, 3% Vectra A 910 (also used in the core), and 0.6% Stabaxol 1—a carbodiimide—was chosen for the sheath.

Both materials were molten in an extruder and pressed via gear pumps into a bicomponent spin pack. The material temperature in the pack was 330° C. Vectra A 910 formed the core stream, while the blend formed the rotation-symmetrical sheath stream.

A spinneret with hole count 40 was used, each spin opening having a hole diameter of 0.80 mm. The output per spinneret hole was 5.79 g/min for the core stream and 2.48 g/min for the sheath stream. Thus, the core occupies about 70%, the sheath about 30% of the cross-sectional surface of the monofil generated under the spinneret.

Below the spinneret, the monofils were fed into a water bath with a deflection pulley. The water temperature was 95° C., the distance between the spinneret and the water surface was 20 cm. Behind the water bath was a doffing/drawing frame.

The calculated spray speed was 11.82 m/min, the doffing speed of the drawing frame was 130 m/min. This resulted in a spin draft of 1:11. This state was frozen in the water bath. Behind the drawing frame, the monofils were wound onto metal disc coils.

In a second step. the wound-up monofils were subjected to the following thermal after-treatment in a recirculatory heater:

heating the room temperature to 160° C. in 70 min
tempering at 160° C. for 24 hours
heating from 160° C. to 180° C. in 30 minutes
tempering at 180° C. for 24 hours followed by cooling to room temperature (about 2 hours)

Following this thermal treatment, the textile properties were as follows:

| | |
|---|---|
| Diameter | 0.5 mm |
| Modulus | >60 GPa |
| Specific strength | 85 cN/tex |
| Elongation at break | 2.2% to 2.5% |
| Free thermal shrinkage at 180 ° C. | <0.1% |

EXAMPLE 2

A fully aromatic polyester, namely the product LCP (Vectra A 910), was chosen for the core, and a blend consisting of a polyethyleneterephthalate modified with 10% isophthalic acid (totalling 40% of the blend) and an elastomeric copolyester (Riteflex 655, 40% of the blend) was chosen for the sheath.

Both materials were molten in an extruder and pressed via gear pumps into a bicomponent spin pack. The material temperature in the pack was 285° C. Vectra A 910 formed the core stream, while the copolyester blend formed the rotation-symmetrical sheath stream.

A spinneret with hole count 40 was used, each spin opening having a hole diameter of 0.80 mm. The output was 319.6 g/min, including 147.3 g/min for the core stream and 172.3 g/min for the sheath stream. The core occupies about 45%, the sheath about 55% of the. cross-sectional surface of the monofil generated under the spinneret.

Below the spinneret, the monofils were fed into a water bath with a deflection pulley. The water temperature was 92° C., the distance between the spinneret and the water surface was 8 cm. Behind the water bath was a doffing/drawing frame.

The calculated spray speed was 11.82 m/min, the doffing speed of the drawing frame was 130 m/min. This resulted in a spin draft of 1:11. This state was frozen in the water bath.

Behind the drawing frame, the monofils were wound onto metal disc coils. There was no thermal after-treatment as in Example 1.

The textile properties of the monofils were as follows:

| | |
|---|---|
| Diameter | 0.6 mm |
| Titre | 3.803 dtex |
| Modulus | 28 GPa |
| Specific strength | 40 cN/tex |
| Elongation at break | 2.5% to 2.8% |
| Free thermal shrinkage at 180 ° C. | <0.2% |

The embodiments of the invention in which an exclusive property or privilege is claimed are defined as follows:

1. A monofilament which displays enhanced abrasion resistance having a diameter of at least 0.01 mm and a sheath core structure wherein the core is formed by the melt extrusion of a liquid crystalline polyester and the sheath is formed by the melt extrusion of a substantially homogeneous blend of 1 to 5 percent by weight polycarbonate and a polyester selected from the group consisting of polyethylene terephthalate, polypropylene terephthalate, polybutylene terephthalate, polyethylene-2,6-naphthalate, poly(1,4-bis(hydroxymethyl)-cyclohexaneterephthalate, and mixtures of the foregoing.

2. A monofilament which displays enhanced abrasion resistance according to claim 1 having a diameter of at least 0.08 mm.

3. A monofilament which displays enhanced abrasion resistance according to claim 1 having a diameter of at least 0.1 mm.

4. A monofilament which displays enhanced abrasion resistance according to claim 1 wherein said liquid crystalline polyester is formed by the polycondensation of 70 to 80 mole percent of p-hydroxybenzoic acid and 20 to 30 mole percent of 2,6-hydroxynaphthoic acid.

5. A monofilament which displays enhanced abrasion resistance according to claim 1 wherein the core makes up 40 to 90 percent of the cross-sectional area and the sheath makes up 10 to 60 percent of the cross-sectional area.

6. A monofilament which exhibits enhanced abrasion resistance according to claim 1 wherein the core is arranged centrally.

7. A monofilament which exhibits enhanced abrasion resistance according to claim 1 wherein the monofilament cross-section is oval, rectangular or n-sided where $n \geqq 3$.

8. A monofilament which exhibits enhanced abrasion resistance according to claim 1 wherein the polyester of the sheath is polyethylene terephthalate.

9. A monofilament which exhibits enhanced abrasion resistance according to claim 1 wherein the polyester of the sheath is polybutylene terephthalate.

10. A monofilament which exhibits enhanced abrasion resistance according to claim 1 wherein the polyester of the sheath is polyethylene-2,6-naphthalate.

* * * * *